US010276136B1

(12) United States Patent
Patrick

(10) Patent No.: US 10,276,136 B1
(45) Date of Patent: Apr. 30, 2019

(54) BRIDGE FOR A VIOLIN-TYPE INSTRUMENT

(71) Applicant: Joseph A. Patrick, Marquette, MI (US)

(72) Inventor: Joseph A. Patrick, Marquette, MI (US)

( * ) Notice: Subject to any disclaimer, the term of this patent is extended or adjusted under 35 U.S.C. 154(b) by 0 days.

(21) Appl. No.: 15/936,627

(22) Filed: Mar. 27, 2018

(51) Int. Cl.
*G10D 3/04* (2006.01)

(52) U.S. Cl.
CPC ..... *G10D 3/04* (2013.01)

(58) Field of Classification Search
CPC ..... G10C 3/26
See application file for complete search history.

(56) References Cited

U.S. PATENT DOCUMENTS 3,730,963 A * 5/1973 Imagawa ..... G10C 3/16 84/251
4,389,917 A * 6/1983 Tiebout, III ..... G10D 3/04 84/307
4,635,523 A * 1/1987 Merchant ..... G10D 3/04 84/307
2015/0310836 A1* 10/2015 Isherwood ..... G10D 3/04 84/309

* cited by examiner

*Primary Examiner* — Kimberly R Lockett
(74) *Attorney, Agent, or Firm* — The Weintraub Group, P.L.C.

(57) ABSTRACT

A stringed instrument plastic bridge, preferably, formed from acrylic may be unitarily formed or modular. When modular the bridge includes ankle pins interposed the hip and feet of the bridge. By using various height feet, ankle pins or various heights, and/or adjustable ankle pins, optimum modular flexibility can be achieved.

6 Claims, 4 Drawing Sheets

BRIDGE FOR A VIOLIN-TYPE INSTRUMENT

BACKGROUND OF THE INVENTION

1. Field of the Invention

The present invention pertains to bridges for stringed instruments. More particularly, the present invention concerns bridges for violin-type instruments. Even more particularly, the present invention concerns the construction of bridges for violin-type instruments.

2. Description of Related Art

As is known to those of ordinary skill in the art to which the present invention pertains, stringed instruments are hollow-bodied instruments that produce sound by converting the vibrations of the strings into audible sounds. A musician plays the instrument by either plucking the strings with his or her fingers, rubbing the strings with a bow, or, in some instances, hitting the strings with a light wooden hammer.

In most stringed instruments, the vibrations from the strings are transmitted to the body of the instrument via a bridge mounted atop the body. The bridge acts as a point of contact between the strings and the body in order to transfer the vibration of the strings to the body. The vibration of the body of the instrument amplifies the vibration of the strings to make it more audible.

The contact point between the strings and the body is, therefore, critical in the construction of these instruments. It is essential that the bridge be specifically designed to appropriately capture the vibration of the strings and transfer this vibration to the instrument body. Thus, there is a substantial difference, for example, between a guitar bridge used on a guitar where the strings are plucked and a bridge for use with a violin, cello, standing bass, viola, and similar violin-type instruments where the strings are bowed.

With a guitar, a guitar bridge is glued directly to the top of the guitar and secures the ends of the strings in place on the body using pins or the like. The bridge includes a saddle extending upwardly therefrom in order to raise the strings above the guitar body and set the string spacing.

On the other hand, violin-type bridges are not used to secure the strings to the body of the instrument. Instead, a tailpiece secures the strings thereto. Hence, the sole purpose of such a bridge is to capture the vibration of the strings and transfer that vibration to the body. Thus, such a bridge requires a dramatically different construction than the bridge of a guitar.

Typically, a violin-type bridge includes a pair of spaced apart feet to support the bridge atop the body of the violin-type instrument. These feet are usually integrally formed with the bridge. When positioned on the instrument, the feet are located above the bass bar and in line with but slightly ahead of the sound post. This misalignment between the treble side bridge foot and the sound post and the resultant interaction with the instrument top is the key to the characteristic sound of the violin family. Unlike guitar bridges, violin-type bridges are not glued to the body of the instrument. Violin-type bridges are instead secured atop a violin-type instrument by being secured in place between the tightened strings and the body of the instrument.

These bridges are typically formed from maple, or a similar hardwood. Wood bridges exhibit a number of disadvantages due to changes in temperature, humidity such as warping, swelling, and shrinking which may result in bridge damage.

However, the prior art has not addressed solutions to these disadvantages of using wood as the preferred material for a violin-type bridge.

For example, U.S. Pat. No. 5,461,932 to Lace teaches a sensor assembly including a bridge for a stringed musical instrument. Instead of the bridge picking up vibrations from the strings directly, Lace teaches positioning the bridge inside of a case having a longitudinal channel, at least one magnet, and an acoustic vibration receptor for receiving the vibrations. To avoid transmitting any distortion from the bridge to the receptor, Lace teaches that the bridge is formed from a material that is not susceptible to a magnetic field, such as an acrylic or other suitable material. Lace specifies that the bridge be disposed within the sensor. However, Lace fails to teach the bridge being used as a standalone device with a violin-type instrument.

U.S. Pat. No. 5,644,094 to Dickson teaches a guitar bridge including a plurality of pedestals. Each pedestal supports a respective string in order to transfer a majority of the vibrations from the strings to the instrument. While Dickson teaches that the bridge may be formed from a cast acrylic, the bridge lacks the structural characteristics of one that can be used in combination with a violin-type instrument.

Each of the devices disclosed in the above references may be suitable for the uses and problems they intend to solve. Nonetheless, there is an ongoing need for improvements in a bridge for use with a violin-type instrument that is formed from a material that remains unaffected by changes in humidity and is cost efficient to manufacture.

Moreover, as noted above, the contact point between the feet of a bridge and the body of a violin-type instrument are critical in transferring optimal vibration from the strings to the instrument and emanating the resulting sound therefrom. Therefore, it is oftentimes desirable to utilize different sized bridges in order to allow for seasonal alignment changes in the instrument. However, the prior art fails to teach such a bridge that can be conformed to multiple violin-type instruments having varying dimensions. Each of the bridges taught in the prior art references above are integrally formed and, thus, fail to teach any modular or interchangeable components for adjusting the height or dimensions of the bridge.

The ability to effectively create a bridge that may be made taller or shorter, adjusts to a curved violin surface, and allows the bridge body to tilt forward and back while the feet remain flat, is desirable.

In this regard, provision of a modular bridge having the ability to use longer and shorter ankle pins and/or feet in order to effectively create a taller or shorter bridge is desirable.

Provision of an arrangement that enables easy height adjustment as well as an indication of the bridge height attained would be desirable.

It is to each of these aspects to which the present invention is directed.

SUMMARY OF THE INVENTION

The present invention provides improvements in violin-type bridges. According to a first embodiment, there is provided a plastic bridge for a violin-type instrument, the bridge comprising:

an integrally formed plastic frame having:

(i) a front surface;

(ii) a rear surface;

(iii) an arcuate top edge, the top edge including a plurality of spaced apart string receiving grooves formed therein;

(iv) a pair of spaced apart arms extending downwardly from opposite ends of the top edge;

(v) a waist portion formed between the pair of arms;

(vi) a horizontally elongated hip formed below the waist portion; and (vii) a pair of spaced apart feet extending downwardly from the hip.

Preferably, the bridge is formed from an acrylic plastic. By manufacturing the bridge hereof from an acrylic or other plastic, warping over time due to humidity is obviated. Therefore, the bridge may be used for longer periods of time without the need for repair or replacement.

The bridge may be formed as a unitary member or may be modular. Where modular, and in a second embodiment hereof, the bridge comprises:

(a) a pair of spaced apart ankle pins removably secured to a bridge hip, the pair of ankle pins extending downwardly from the hip; and (b) a pair of spaced apart feet being secured to respective ends of the pair of ankle pins opposite the hip.

Here, the modular bridge provides the ability to interchange the feet based on a specific stringed instrument by securing them to the feet. In order to removably secure the feet to the frame, a pair of bores are formed at opposite ends of the hip. The feet have counter sunk holes to receive the hemi-spherical bottom ends of the ankle pins and everything is held in place by string tension. The bores in the hip register with associated bores in the feet. The ankle pins are push fitted into respective bores in the hip and may be interchanged and/or removed.

Alternatively, the modular bridge may comprise; in lieu of the ankle pin arrangement, a pair of threadably adjustable legs removably connected to the hip whereby the legs translate incrementally relative to their connection and move towards and away from the hip.

For a better understanding of the present invention, reference is made to the accompanying drawing and detailed description. In the drawing, like reference numerals refer to like parts through the several views, in which:

DETAILED DESCRIPTION OF THE INVENTION

At the outset, it is to be noted that the present invention is directed to a violin-type instrument, such as a violin, viola, cello, double bass, and the like. However, throughout the ensuing description, and for ease of simplicity, such bridges will collectively be discussed with reference to a violin bridge.

Figure 1:
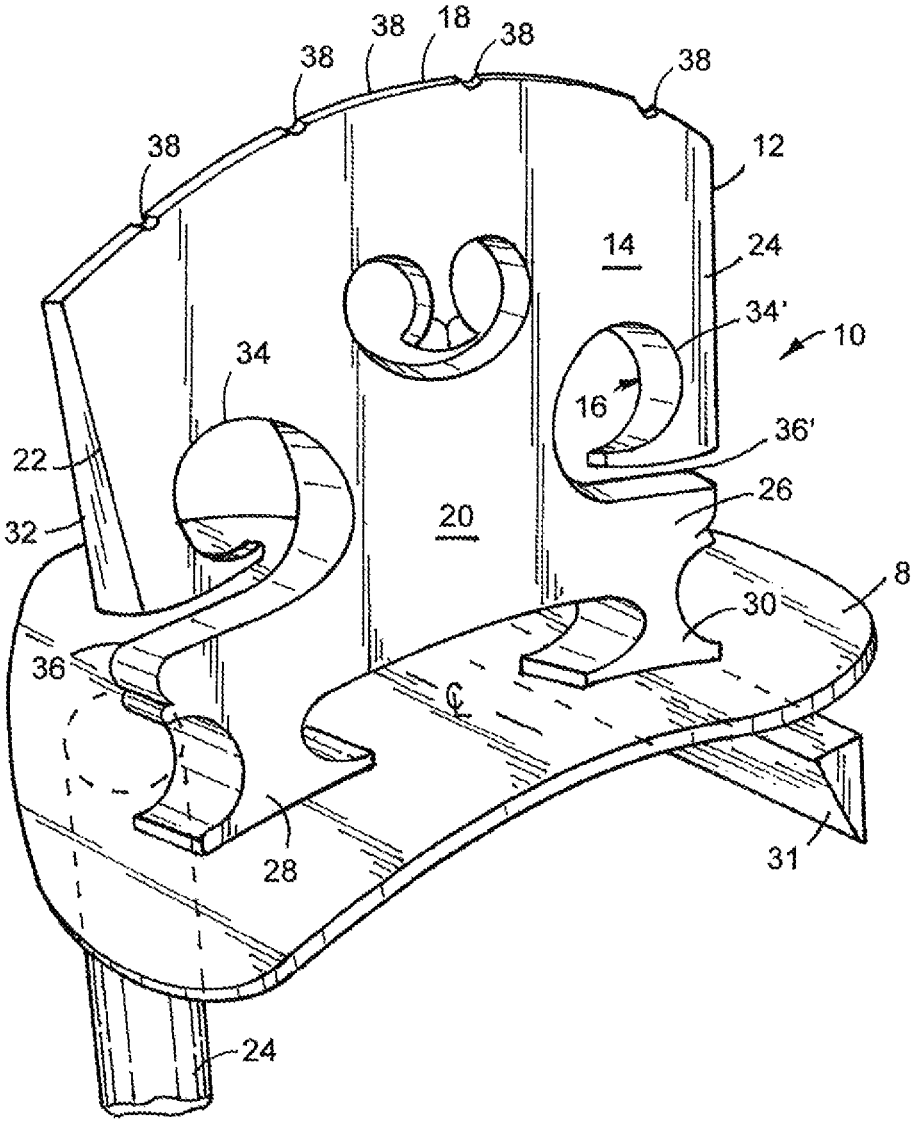
FIG. 1 is a perspective view of a first embodiment of a bridge in accordance with the present invention, seated atop a violin.

Referring now to FIG. 1 of the drawing, there is shown therein a plastic bridge denoted at 10 seated on a violin 8 in accordance herewith.

The bridge 10, generally, comprises:

an integrally formed plastic frame or body 12 having:

(a) a front surface 14;

(b) a substantially flat rear surface 15;

(c) an arcuate top edge 18, the top edge 18 including a plurality of spaced apart string receiving grooves 38 formed therein;

(c) a pair of spaced apart arms 22, 24 extending downwardly from the top edge 18;

(e) a waist portion 20 formed between the pair of arms 22, 24;

(f) a horizontally elongated hip 26 formed below the waist portion 20; and (g) a pair of spaced apart feet 28, 30 extending downwardly from the hip 26.

The frame 12 further includes a pair of opposed side edges 32, only one of which is shown.

The string-receiving grooves 38 allow each of the strings to nest within a respective groove 38 to maintain their position thereon.

The side edges 32 of the frame 12 extend downwardly from opposite ends of the top edge 18. Preferably, as shown, the front surface 14 and the rear surface are slightly angled away from one another such that the side edges 32 have a tapered width that gradually decreases as the side edges merge with the top edge 18.

As is known to those skilled in the art, the front surface is commonly referred to as the contoured side of the bridge and the rear surface as the flat side. The contoured side is positioned on the instrument such that it faces the headstock.

Bridges having a top edge 18 of differing thickness result in a variety of sound outputs by creating a larger or smaller contact point with the strings of the instrument. This can be useful when matching bridges, strings, and instruments.

The arms 22, 24 extend downwardly from the top edge 18, proximate each of the side edges 32 and flare inwardly toward the center of the frame 12, as shown.

The waist portion 20 has a pair of openings 34, 34' formed within the frame 12 between each of the arms 22, 24 and on opposite sides of the waist portion 20.

A pair of horizontal slots 36, 36' are formed in the frame 12 between the arms 22, 24 and the hip 26.

A pair of openings 34, 34' cooperate with the slots 36, 36' to allow the bridge 10 to vibrate more freely, which facilitates the transfer of vibrations originating at the top edge 18 to the feet 28, 30.

The slots 36, 36' provide the bridge 10 with a wing-slot bridge configuration for accepting a pickup such as that disclosed in U.S. Pat. No. 9,495,948 to Patrick, which is hereby incorporated by reference in its entirety. In use a pickup may be disposed within either one of the slots 36, 36'. Thereafter, the signal is transmitted to an external audio amplification system.

The spaced apart feet 28, 30 are secured or integrally formed with to the hip 26 and extend downwardly therefrom, preferably, proximate the opposite ends of the hip 26.

As is known in the art, and as shown in FIG. 1, one of the feet, here, foot 30 is a bass foot and the other foot 28 is a treble foot. The significance of distinguishing between the feet 28 and 30 is that, when the bridge 10 is positioned on a violin, the bass foot 30 and the treble foot 28 are positioned over a bass bar 31 and near a sound post 29, respectively, to ensure that vibration is adequately transferred to the instrument.

The bridge pivoting that occurs during use is further emphasized by the vibrations near the bass foot 28 and the treble foot 30. Typically, the treble foot 28 vibrates vertically as the strings vibrate and the bass foot 30 remains relatively fixed.

As noted above, violin bridges are typically formed from wood. However, the bridge 10 hereof is formed from a plastic capable of enabling vibratory translation. Preferably, the bridge is an acrylic bridge.

Typically, manufacturing a bridge from an acrylic will result in cheaper material costs, since acrylic plastics are cheaper than fine grade maple. Additionally, manufacturing the bridge 10 out of an acrylic provides the ability to manufacture bridges in a wider variety of colors and various designs. An acrylic bridge can, therefore, be transparent, translucent, or have various fluorescent hues, which is not possible with wood bridges.

Taking into consideration the varying sizes, shapes, and configurations of violin bridges, an acrylic material also provides the ability to be easily molded and formed into almost any shape via extrusion blow molding, injection molding, machining or hand crafting.

The most important advantage in manufacturing the bridge 10 from an acrylic is the ability to avoid warping over time. Wood bridges tend to warp due to changes in humidity and temperature. However, a bridge formed from an acrylic does not warp. Thus, the bridge 10 can be used for longer periods of time, thereby avoiding the need for repair or replacement.

Additional advantages of acrylic versus wood is that acrylic wears better than wood where the string slots are located, particularly the "E" string. Most violin bridges are fitted with a small piece of rawhide or parchment paper called a "skin" which is saturated with glue and folded over the bridge top at the "E" string location. This serves to harden the "E" string slot so the string does not dig in.

Figure 2:
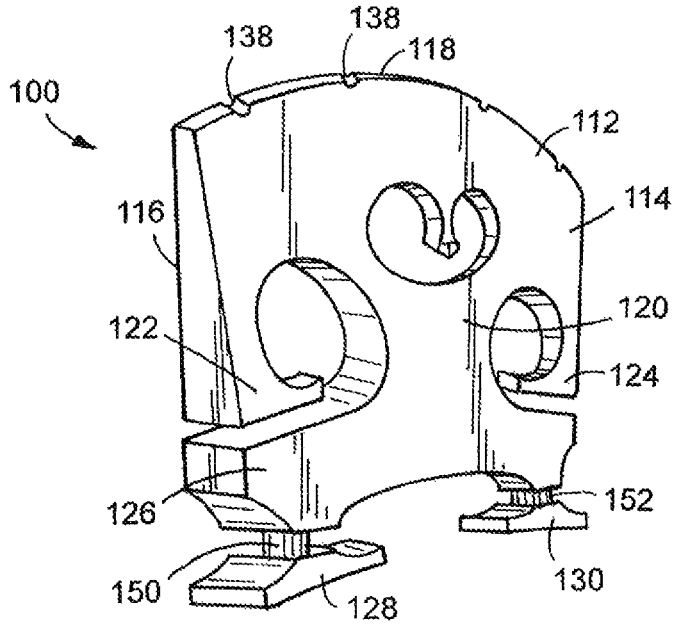
FIG. 2 is a partial, perspective view of a second embodiment of the bridge.
Figure 3:
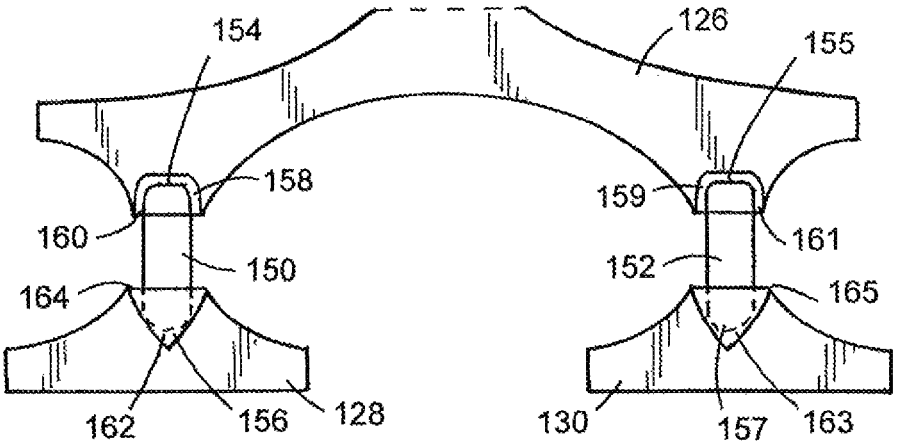
FIG. 3 is a broken, partial plan view of the bridge of FIG. 2 in accordance with the present invention.
Figure 4:
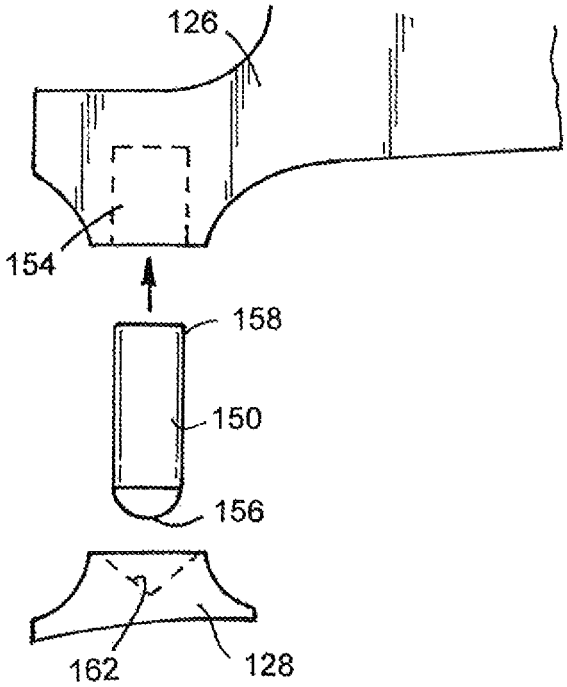
FIG. 4 is an exploded plan view, partly in phantom of a foot, ankle pin and bridge body assembly.

Referring, now, to FIGS. 2 through 4, of the drawing, there is shown therein a modular bridge denoted at 100. The bridge 100 has a substantially similar structure to that of the bridge 10 discussed above with the exception of the removable ankle pins 150, 152 and feet 128, 130, as described hereinafter. Thus, the modular bridge 100, generally, comprises:

(a) an integrally formed frame 112 having:

(i) a front surface 114;

(ii) a rear surface 116;

(iii) an arcuate top edge 118, the top edge 118 including a plurality of spaced apart string receiving grooves 138 formed therein;

(iv) a pair of spaced apart arms 122, 124 extending downwardly from opposite ends of the top edge 118;

(v) a waist portion 120 formed between the pair of arms 122, 124;

(vi) a horizontally elongated hip 126 formed below the waist portion 120;

(b) a pair of spaced apart ankle pins 150, 152 removably secured to the hip 126, the pair of ankle pins 150, 152 extending downwardly from the hip 126; and (c) a pair of spaced apart removable feet 128, 130 secured to the free ends of the ankle pins 150, 152.

The feet 128, 130 being removably connectable with the hip 126 provide a modular bridge assembly. This modular assembly allows the utilization of feet and/or ankle pins having different lengths such that the height of the bridge 100 may be adjusted, as desired.

Here, the hip 126 includes a pair of substantially rectangular bores 158, 159 formed in lower ends 160, 161 of the hip 126 for receiving an end of an associated complementary configured ankle pin 150 or 152 to provide a tight fit.

The bores 158, 159 may be initially molded within the hip 126 or otherwise formed by any suitable means such as drilling or the like. As shown in FIGS. 3 and 4, the bores 158, 159 are cylindrical and have a flat end to mate with top ends 154, 155 of respective ankle pins 150, 152 to provide maximum contact. The diameter of the bores 158, 159 are dimensioned such that of the ankle pins 154, 155 are frictionally retained within, or such fitted into the bores 158, 159.

Similarly, a pair of 90° countersunk holes or openings 162, 163 are formed in the top edges 164, 165 of respective feet 128, 130. The openings 162, 163 are cone-shaped which receive the hemispherical bottom ends 156, 157 of respective ankle pins 150, 152.

When the feet 128, 130 are positioned below the hip 126, the bores 158, 159 in the hip 126 register with the holes 162, 163 in the feet 128, 130. The ankle pins 150, 152, by being tightly push fitted into the bridge frame or body renders them rigid with respect thereto. The bottom end of the pins are ground to a hemispherical shape which centers them in the conical countersunk holes in the top of the feet 128, 130. This feature allows for an accurate and self-centering "best fit" between the instrument top and the feet.

As shown in FIGS. 3 and 4, the ankle pins 150, 152 are elongated, cylindrical members push fitted into respective bores 158, 159 in the hip 126 and ride in the 90° countersunk holes of the feet. The assembly is held in place by string tension.

As shown, each ankle pin 150, 152 is identical in structure. The top ends 154, 155, are squared off and correspond to bores 158, 159. The bottom ends 146 and 157 have a hemispherical surface corresponding to the countersunk holes 162, 163.

The ankle pins can be formed from metal, hardwood, plastic, carbon fiber, or suitable composites. Preferably, the ankle pins are formed from a carbon-fiber composite. It has been found that this provides a more natural sound without any metallic or other overtones of its own, which is inherent with brass or aluminum ankle pins.

It should be appreciated that different violin-type instruments have varying curvatures and this modular bridge configuration allows a user to use differently contoured feet with a single bridge in order to better conform the bridge to the body of the instrument and transfer vibration more efficiently.

Additionally, the ability to use longer and shorter ankle pins and/or feet to effectively create a taller or shorter bridge, as desired. Thus, the modular bridge 100 hereof may be packaged as a kit including a single frame 112 and a plurality of ankle pins 150, 152 and feet 128, 130, each having different dimensions for creating specifically desired results.

It is to be understood that the modular bridge 100 may be formed from any suitable material such as an acrylic, as described above with respect to the bridge 10.

Figure 5:
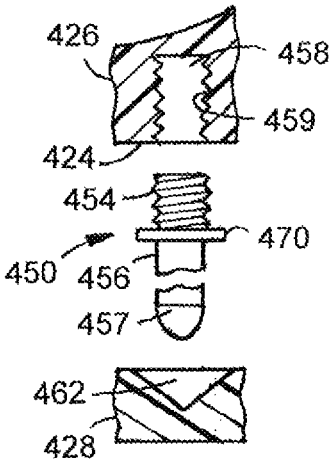
FIG. 5 is a front elevation view of an alternate embodiment of a modular bridge in accordance herewith, having a height adjustment arrangement.
Figure 6:
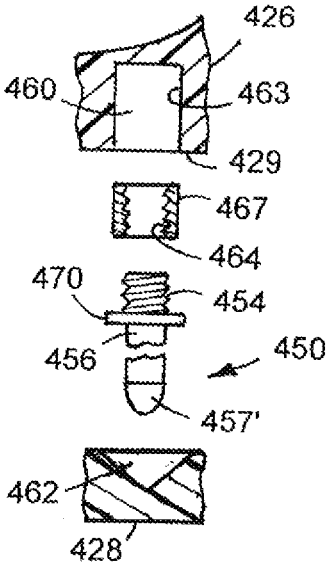
FIG. 6 an exploded partial view of the height adjustment arrangement associated with the bridge of FIG. 5.
Figure 7:
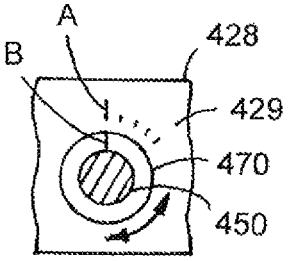
FIG. 7 is a top view of the assembly of FIG. 6.

Referring now to FIGS. 5-7, there is shown an alternate modular bridge, generally denoted at 400. Here, the modular bridge 400 includes a height adjustment arrangement for changing the vertical separation of the body portion or hip 426 relative to the feet 428, 430 whereby the body portion or hip 426 of the bridge 400 may be moved vertically up and down away from the two feet 428, 430.

The modular bridge 400 has a substantially similar structure to that of the modular bridge discussed above, but uses modified removable ankle pins. Here, nested seating of the lower hemispherical ends 457, 457' of the pins 450 in countersunk 90° sockets 462 allow the feet 428 to adjustably seat atop and against a curved top surface of the violin.

The height adjustment arrangement herein provides a modular assembly that allows the feet and ankle pins to be interchanged with ones having different shapes or mounting surfaces such that the height of the bridge 400 may be adjusted, as desired.

As shown, the bores 458, 460 are generally cylindrical having a flat top and the walls 459 thereof are threaded. Further, the upper end portions 454 of the ankle pins 450 are threaded and threadably connected to the bridge via a respective bore 458. The lower end portions 456 of the pins 450 are, as before, generally cylindrical, elongated, and unthreaded. The lower ends 457 are hemispherical and dimensioned to nest in a respective socket 462 in a manner that allows the feet 428 to "teeter-totter" slightly and seat against the slightly curved violin surface. Additionally, this also allows considerably more variation in height than allowed by solid bridges.

The hip 426 includes a pair of laterally spaced generally cylindrical bores 460 having an interior wall 463. The walls of the bores 460 are generally formed in a manner described elsewhere herein. Further, the hip 426 receives a pair of hollow generally cylindrical sleeves 462. The sleeves are dimensioned to be received in a respective bore 460 and frictionally fit against a wall 463 thereof and be non-rotatably retained within the bore. Each sleeve 467 defines an interior threaded cylindrical wall 464. The threaded upper end portions 454 of the legs 450 are adapted to be fitted into a respective sleeve 467 and be threadably engaged with the thread in the respective receiving sleeve.

Rotation of the pins 450 causes the legs to move relative to the threaded connection and to translate relative to the hip 426, and thereby incrementally translating or moving the lower end 457 of the leg relative to its associated foot.

According to this embodiment, the ankle pins 450 are provided with a turn collar and thus translate the feet relative to the hip and adjust the height of the modular bridge. As shown, the surface 429 of the hip 426 that faces the turn collar includes reference lines "A" and the turn collar 470 includes a reference line "B". The lines "A" are angularly separated by an amount that when registered with the line "B", the user knows that the pin 450 has incrementally translated by a known axial amount.

The turn collar 470 and the bottom facing surface 429 of the hip 426, where the pin enters the bore 458 or 460, may be provided with indicia to indicate to the user whether each leg is rotated by a like amount and has the same or different extension/retraction relative to the hip.

As with the second embodiment the modular bridge 400 desirably provides the user with an ability to use longer and shorter ankle pins or legs 450 in order to effectively create a taller or shorter bridge.

It is to be understood that the modular bridges 100 and 400 are preferably formed from any suitable material such as an acrylic, or other plastic as described above with respect to the bridge 10, or it may be formed entirely from wood. Also, as noted above, the ankle pins 450 are preferably formed from carbon-fiber and the like, as are the sleeves 467. However, although less preferred, the pins 450 and/or sleeves 467 may be formed from brass, aluminum and the like.

It should further be noted that by providing the ankle pin with a hemispherical lower end which nests within a conical opening in the foot enables not only alignment adjustments but for string length as well. Also, by having the adjustability herein, the feet can be rotated to properly fit the top of the instrument.

A piezoelectric pickup (not shown) is positionable under either arm of the bridge. The pickup converts physical vibrations from the violin into an analog electric signal that can then be sent to an amplifier (not shown) in the well-known manner.

From the above, it is to be appreciated that defined herein is a new and unique plastic and/or modular bridge for a violin-type instrument which overcomes the drawbacks of integrally formed, wood bridges in the prior art.

LIST OF REFERENCE NUMERALS

8 Violin top
10 Bridge
12 Frame
14 Front surface
16 Rear surface
18 Top edge
20 Waist portion
22 Arm
22 Arm
24 Hip
26 Treble foot
28 Sound post
30 Base foot
31 Bass bar
32 Side edge
34 Opening
34' Opening
36 Slot
36' Slot
38 Grooves in top edge
100 Modular bridge (mine)
110 Bridge
112 Frame
114 Front surface
116 Rear surface
118 Top edge
120 Waist portion
122 Arm
124 Arm
126 Hip
128 Treble foot
130 Bass foot
138 Grooves in top edge
150 Ankle pin
152 Ankle pin
154 Top of ankle pin
155 Top of ankle pin
156 Bottom of ankle pin
157 Bottom of ankle pin
158 Bore in hip
159 Bore in hip
160 Lower end of hip
161 Lower end of hip
162 Hole in foot
163 Hole in foot
164 Top edge of foot
165 Top edge of foot
400 modular bridge (yours)
420 bridge frame

426 hip
428 feet
429 bottom surface
450 leg/ankle pin
454 (threaded) upper end portion/450
456 lower end portion/450
457 bottom end/450
458 bore/126
459 (threaded) end portion/458
460 bore 462 countersunk bore
463 wall/460464 (threaded) inner wall/462
467 sleeve
470 turn collar/nut/450

The invention claimed is:

1. A bridge comprising:

an integrally formed plastic frame or body having:

(a) a front surface;

(b) a rear surface;

(c) an arcuate top edge, the top edge including a plurality of spaced apart string receiving grooves formed therein;

(c) a pair of spaced apart arms extending downwardly from the top edge;

(e) a waist portion formed between the pair of arms;

(f) a horizontally elongated hip formed below the waist portion and a pair of spaced apart bores formed in the bottom of the hip;

(g) a pair of spaced apart feet each foot having a wedge-shaped bore formed therein; and (h) a pair of spaced apart ankle pins removably secured in a corresponding bore in the hip and extendable downward therefrom and being insertable into the wedge-shaped bore of an associated foot, each of the ankle pins having a hemispherical lower end to enable each pin to be fitted into its associated foot.

2. The bridge of claim 1 wherein, the bridge is a modular bridge.

3. The bridge of claim 1, wherein:

the ankle pins are each threadingly connectable to the hip and its associated bore, the pins being rotatably incrementally movable to adjust the height of the bridge.

4. The bridge of claim 1, wherein the bridge is formed from an acrylic.

5. The bridge of claim 2, wherein the ankle pins are carbon fiber ankle pins.

6. The bridge of claim 1 wherein each ankle pin has an upper threaded portion, each bore formed in the hip is threaded to threadably inter-engage and threadably receive its associated ankle pin.

* * * * *